United States Patent [19]

Hirayama et al.

[11] 4,296,357

[45] Oct. 20, 1981

[54] PLASMA DISPLAY SYSTEM

[75] Inventors: Tsutomu Hirayama; Hiroshi Hada, both of Tokyo, Japan

[73] Assignee: Nippon Electric Co., Ltd., Tokyo, Japan

[21] Appl. No.: 90,718

[22] Filed: Nov. 2, 1979

Related U.S. Application Data

[63] Continuation of Ser. No. 947,227, Sep. 29, 1978, abandoned.

[30] Foreign Application Priority Data

Sep. 29, 1977 [JP] Japan ..... 52-117622
Jul. 14, 1978 [JP] Japan ..... 53-86268
Aug. 8, 1978 [JP] Japan ..... 53-97079

[51] Int. Cl.[3] ..... H05B 41/30

[52] U.S. Cl. ..... 315/169.4; 340/713; 340/805

[58] Field of Search ..... 315/169.4; 340/713, 340/805, 814

[56] References Cited

U.S. PATENT DOCUMENTS 3,803,448 4/1974 Nolan ..... 340/805 X
3,833,832 9/1974 Fein et al. ..... 315/169.4
3,840,779 10/1974 Schermerhorn ..... 340/805 X
3,969,718 7/1976 Strom ..... 340/814 X

*Primary Examiner*—Eugene R. LaRoche
*Attorney, Agent, or Firm*—Sughrue, Mion, Zinn, Macpeak and Seas

[57] ABSTRACT

A plasma display system in which display cells in an external electrode type plasma display panel are forcibly fired at a predetermined period regardless of given display signals, which can greatly improve turn-on characteristics of a display without adversely affecting the display function.

12 Claims, 29 Drawing Figures

82
T 111
t
2T

+V
0
31, 32, ··· 3M

+V
0
91

+V
0
92

+V
0
93

+V
0
-V
P1

+V
0
-V
P2

+V
0
-V
P3
τ1
τ2

T1
T2
Tn-1
Tn
81
t
112
Tu
301,302,···30M
+V
0
-V
191
192
291
292
n91
n92
P11
P12
P21
Pn1
t1
t2
tn

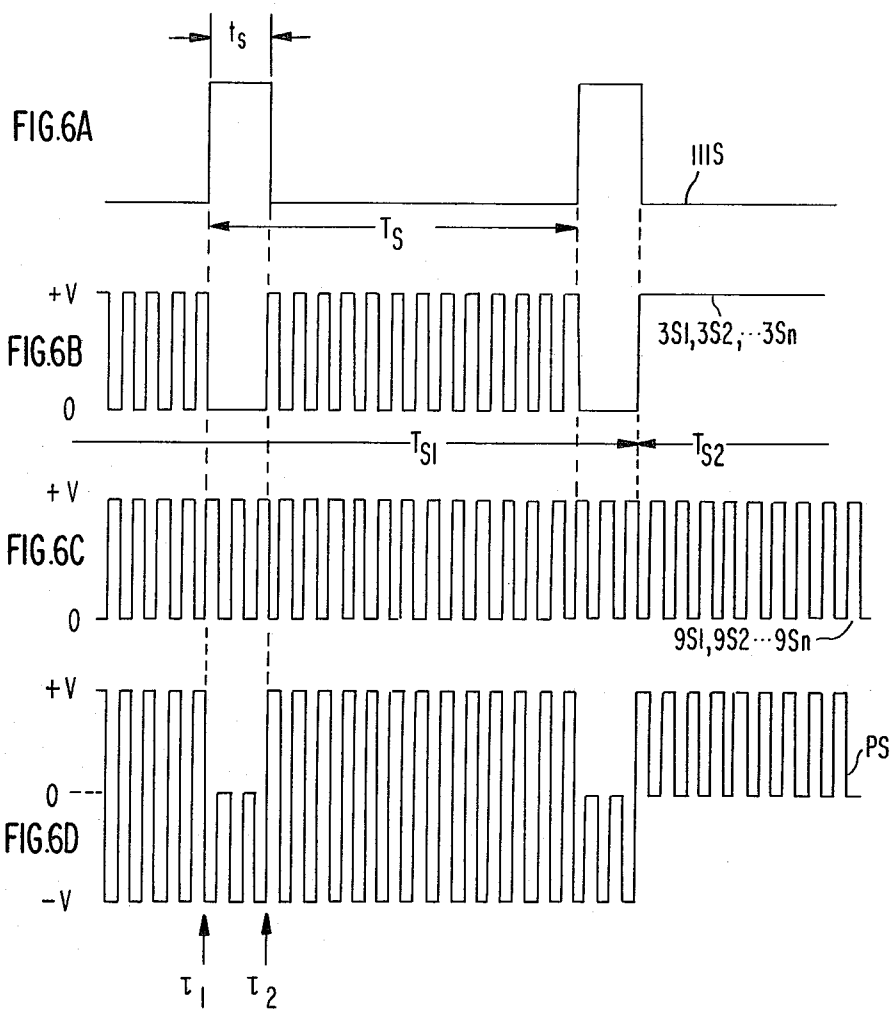
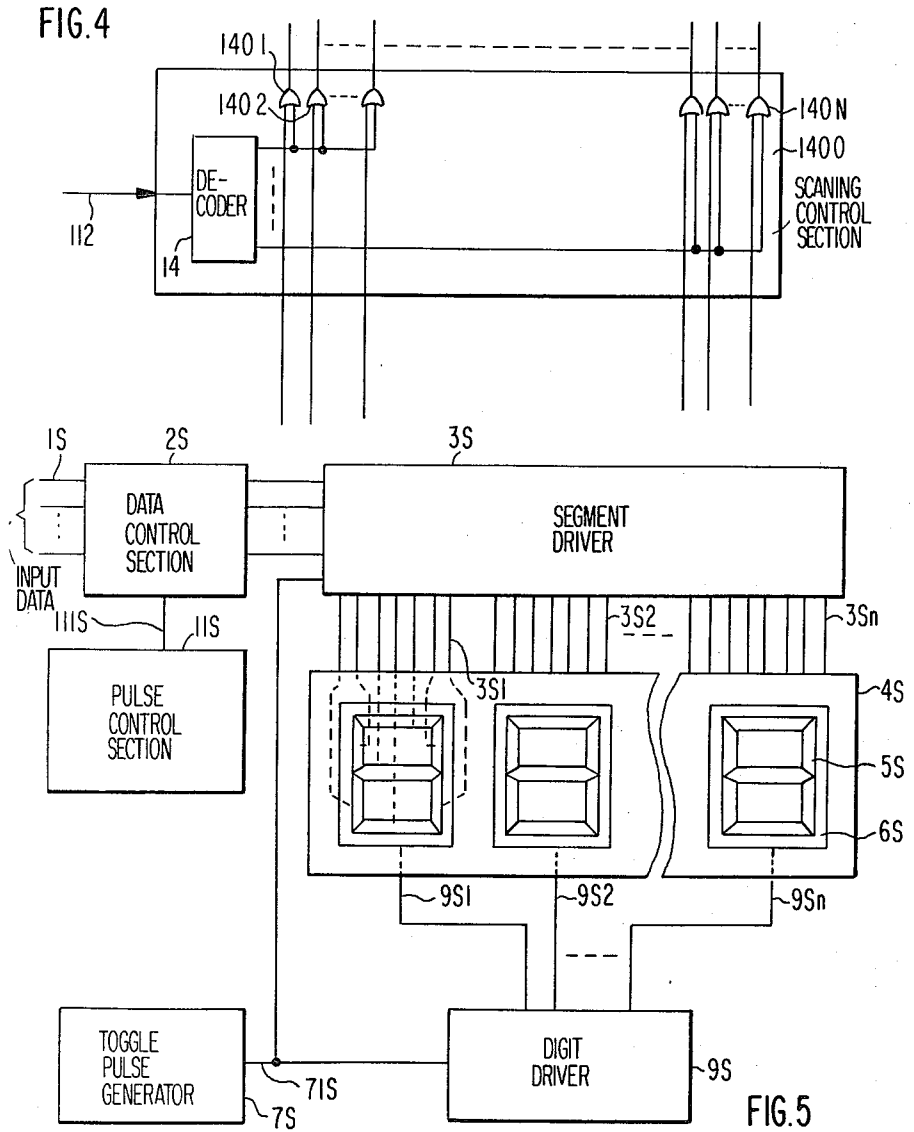
FIG.4
FIG.5

PLASMA DISPLAY SYSTEM

This is a continuation of Ser. No. 947,227, filed Sept. 29, 1978, now abandoned.

BACKGROUND OF THE INVENTION

The present invention relates to a discharge display system, and more particularly, to a driving circuit for an external electrode type plasma display panel.

Regarding the above-described type of plasma display panels (hereinafter called simply "display panles"), there has been generally known a system in which a row electrode group consisting of a plurality of generally transparent row electrodes arranged in parallel to each other and a column electrode group consisting of a plurality of generally opaque column electrodes arranged in parallel to each other are arrayed in a matrix form, with an ionizable gas interposed between the respective electrode groups, and a discharge luminescent display is made at a crosspoint between a selected row electrode and a selected column electrode. With the aforementioned display panel, an optical image corresponding to an input signal can be displayed by controlling the electrode selecting system for the row electrode and column electrodes in response to the input signal. For instance, an optical image corresponding to an input signal can be displayed on the display panel by successively selecting and scanning the respective electrodes in either one of the row electrode group and the column electrode group, for example, in the column electrode group on a time-division basis, and selectively controlling the respective electrodes in the other electrode group, for example, the row electrode group in response to the input signal while synchronizing with the scanning. In the so-called external electrode type display panel in which the respective electrodes are covered by a dielectric film, it is necessary to drive the panel with an AC voltage, and high frequency pulses called "toggle pulses" are included in the driving signals applied to the row electrode group and the column electrode group. Examples of such a driving circuit are disclosed in "NEC RESEARCH & DEVELOPMENT" No. 30, July 1973, pp 56–63, and in the article by the inventors of this invention presented in "NEC RESEARCH & DEVELOPMENT" No. 46, July 1977, pp. 18–23, especially in FIG. 5 on page 22.

In the case where the external electrode type display panel is operated after it has been left unused for a long period of time, e.g., several days, an initial discharge hardly occurs because the gas in the display panel is almost not ionized, so that it takes a long time until commencement of discharge after application of a firing signal, and thus the display panel has a disadvantage that the so-called turn-on time becomes long.

Also it has a disadvantage that where an unselected cross-point in the display panel newly takes a selected state, likewise the turn-on time becomes long.

A method for improving the delay of the initial discharge is proposed in U.S. Pat. No. 3,842,314 assigned to the same asignee as this application. More particularly, according to this U.S. patent, a circuit for superposing a DC voltage on a driving voltage is added, and thereby only when the power source is switched ON in the first place, all the cells emit light only once. In the subsequent operation, however, the superposed DC voltage has no function to accelerate the firing, so that the reliability of firing when an unselected cell has been newly selected is not high. Furthermore, addition of the above-described DC voltage superposing circuit to every display cell is of high cost and not practical.

SUMMARY OF THE INVENTION

It is an object of the present invention to provide a plasma display system in which the delay of commencement of initial discharge can be greatly improved.

Another object of the present invention is to provide a plasma display panel in which not only the delay of commencement of initial discharge but also turn-on characteristic upon operation can be greatly improved.

According to one feature of the present invention, a plasma display system is characterized in that display cells in the display panel are forcibly discharged at a predetermined period.

According to another feature of the present invention, there is provided a plasma display system in which all the display cells are divided into a plurality of regions and are forcibly discharged at a predetermined period in each region.

The foregoing and other objects of the invention are attained in a discharge display system comprising a display panel including a coplanar array of similar gas discharge cells and first and second pluralities of electrodes external to said cells arranged so that each cell is interposed between an electrode of said first plurality and an electrode of said second plurality. Generating circuitry supplies a group of alternating polarity pulses to the electrodes associated with a selected cell. The voltage of these pulses is larger than the firing voltage of the selected cell. Another circuit periodically supplies a firing pulse to the electrodes associated with an arbitrary cell. The number of discharging times included in this firing pulse is smaller than that included in the group of alternating polarity pulses so that the contrast of brightness between the selected cell and the arbitrary cell is high. The display panel can be of the dot-matrix type or segment type. In either case, the initial discharge delay of the cell is reduced.

BRIEF DESCRIPTION OF THE DRAWINGS

FIG. 4 shows an equivalent circuit for a scanning control section in FIG. 1 according to the second preferred embodiment of the present invention;

FIG. 5 is a block diagram showing another preferred embodiment of the present invention as applied to a segment display type of plasma display panel; and FIGS. 6A to 6D are waveform diagrams showing waveforms at various points in FIG. 5.

DESCRIPTION OF PREFERRED EMBODIMENTS

Figure 1:
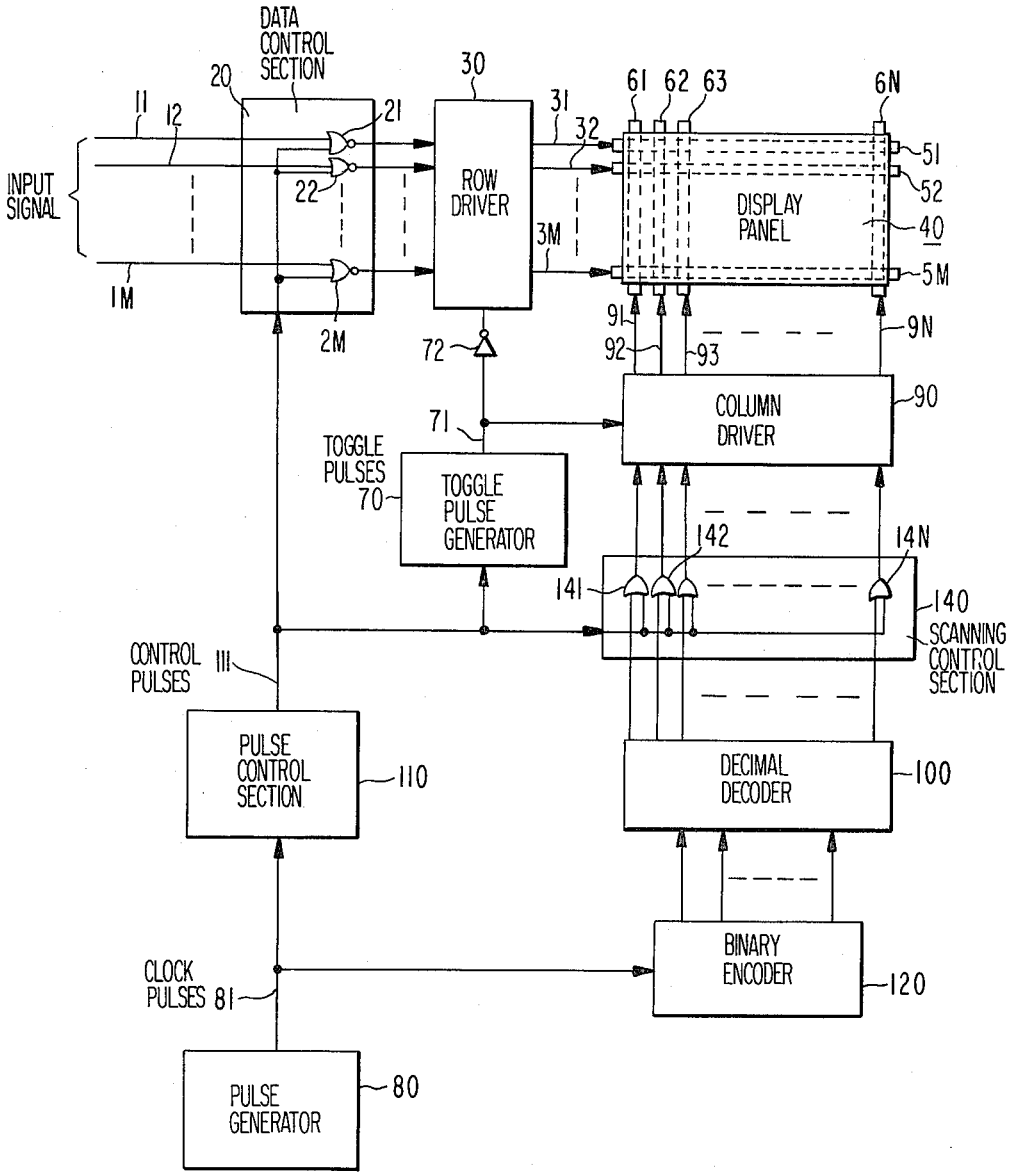
FIG. 1 is a block diagram showing a plasma display system according to the present invention as applied to a matrix display type of plasma display panel.

Referring now to FIG. 1, input signals 11, 12, . . . 1M containing display data which are sent from a buffer register (not shown), are mixed with control pulses 111 fed from a pulse control seciton 110 in a data control section 20, and then they are applied to a row driver 30. In the row driver 30, the output signals of the data control section 20 are mixed with toggle pulses 71 fed from a toggle pulse generator 70 through an inverter 72, and after they have been stepped up to the driving voltage of a display panel 40, they are applied to the corresponding row electrodes 51, 52, . . . , 5M respectively.

On the other hand, clock pulses 81 fed from a pulse generator 80 are converted in an encoder 120 into binary bit signals corresponding to the number of column electrodes 61, 62, 63, . . . 6N. The bit signals fed from the encoder 120 are converted in a decoder 100 into decimal numbers to successively generate pulses equal in number to the number of column electrodes 61, 62, 63, . . . 6N. Further, the output signals from the decoder 100 are mixed with control pulses 111 in a scanning control section 140, thereafter they are mixed with the toggle pulses 71 fed from a toggle pulse generator 70 in a column driver 90, and after they have been stepped up to the driving voltage of the display panel 40, they successively select and scan the respective column electrodes 61, 62, 63, . . . 6N. Since the selection of the row electrodes 51, 52, . . . 5M is synchronized with the input 11, 12, . . . 1M as well as the scanning of the column electrodes 61, 62, 63, . . . 6N, an optical image corresponding to the input signals 11, 12, . . . 1M can be displayed on the display panel 40.

Now, one preferred embodiment of the present invention will be described in greater detail with reference to the voltage waveforms illustrated in FIGS. 2A to 2I. In this preferred embodiment, under the control of the control pulses 111 fed from the pulse control section 110, all the row and column electrodes are brought into selected states once in every other period with respect to the period in which the column electrode group is scanned, that is, with respect to the refresh period T, to fire all these matrix cross-point, and thereby ionization of the gas interposed between the respective electrode groups is assured to shorten a turn-on time of the display panel.

Figures 2A, 2B, 2C, 2D, 2E, 2F, 2G, 2H, 2I:
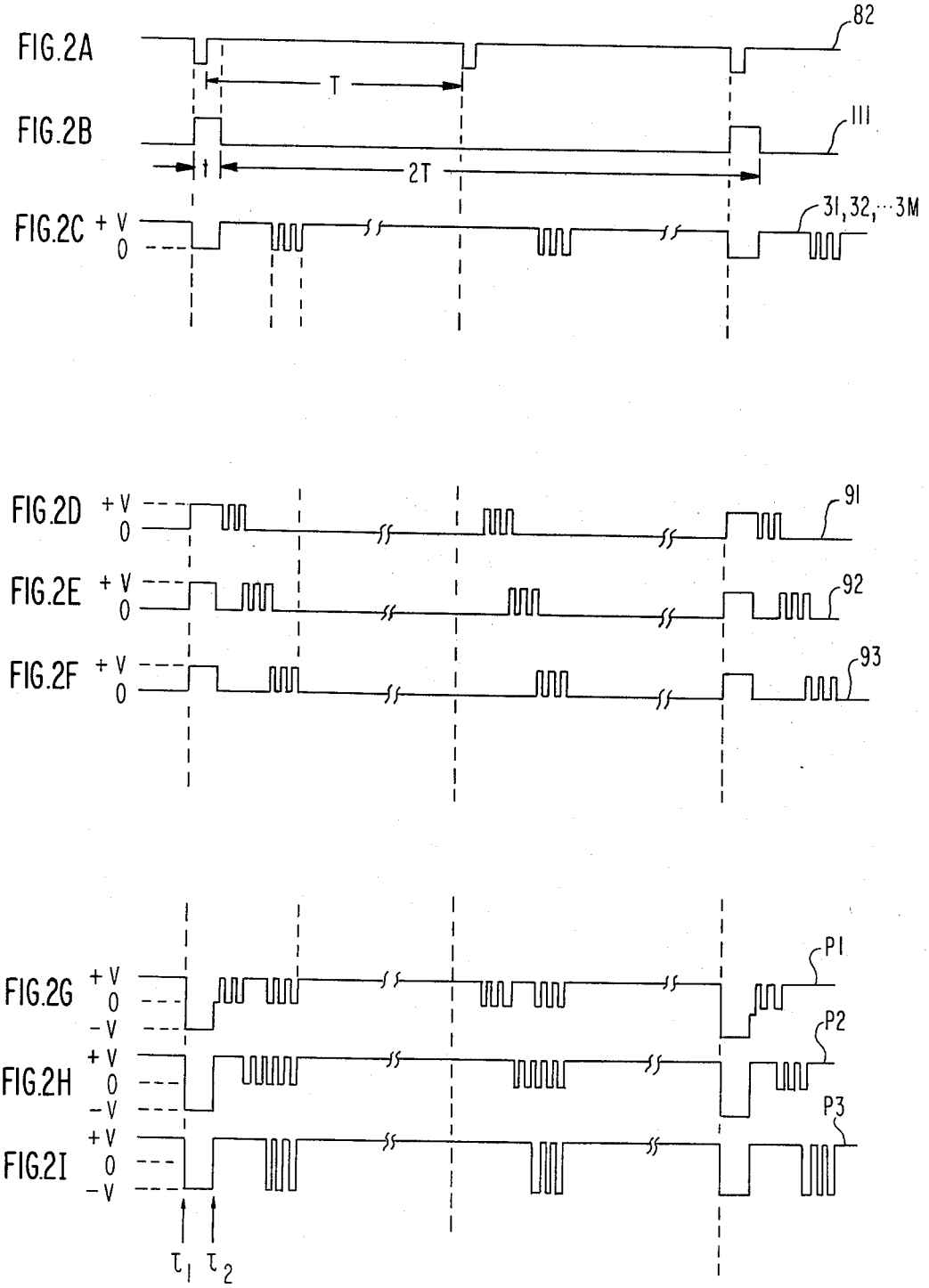
FIGS. 2A to 2I are waveform diagrams showing waveforms at various points in FIG. 1, according to a first preferred embodiment of the present invention.

In the pulse control section 110, control pulses 111 having a period 2T and a pulse width equal to a period t of clock pulses 81 as shown in FIG. 2B are generated by counting down reset pulses 82, having a period equal to the refresh period T of the column electrodes 61, 62, 63, . . . 6N as shown in FIG. 2A, by one-half.

In the data control section 20, the input signals 11, 12, . . . 1M and the control pulses 111 are inputted to NOR gates 21, 22, . . . 2M, and the output signals of the NOR gates 21, 22, . . . 2M are inputted to the row driver 30. If the circuit illustrated in FIG. 5 on page 22 of the above-referred literature "NEC RESEARCH & DEVELOPMENT" No. 46, July 1977 is employed as the driver 30, then the output 71 of the toggle pulse generator 70 can be directly inputted to the row driver 30, and thereby row driving signals 31, 32, . . . 3M as shown in FIG. 2C can be obtained. For simplicity of explanation, it is assumed that row driving signals 31, 32, . . . 3M on the row electrodes 51–5M all have the same waveform.

On the other hand, the output signals from the decoder 100 and control pulses 111 are inputted to OR gates 141, 142, . . . 14N in the scanning control section 140. By employing the circuit disclosed in the above-referenced literature also for the column driver 90, the toggle pulses 71 and the output signals of the scanning control section 140 can be inputted to the column driver 90. Assuming that the number of the column electrodes in the display panel 40 is N, then in correspondence to the respective column electrodes 61, 62, . . . 6N, column driving signals 91, 92, 93, . . . 9N can be obtained, and in FIGS. 2D, 2E and 2F are shown the column driving signals 91, 92 and 93 corresponding to the first three column electrodes 61, 62 and 63.

Combined signals P1, P2 and P3 comprising the row driving signal 31 and the column driving signals 91, 92 and 93, respectively, takes the waveforms as shown in FIGS. 2G, 2H and 2I, and these combined signals P1, P2 and P3 are applied between the row electrode 51, 52 or 53 and the column electrodes 61, 62 and 63, respectively.

At the time point $\tau_1$ and $\tau_2$, the combined signals P1, P2, . . . PN would take a higher voltage than the firing voltage of the display panel 40 regardless of the input signals, resulting in discharge and light emission at all the matrix cross-points in the display panel 40. The discharge current through the display panel 40 is directed in the opposite directions to each other at the time points $\tau_1$ and $\tau_2$ and normally these discharges in pairs are called one discharge. Between the time points $\tau_1$ and $\tau_2$, toggle pulses are eliminated by switching off the toggle pulses 71 in response to the control signal 111.

As described above, all the matrix cross-points in the display panel 40 are brought into selected states resulting in discharge at all the cross-points once in a period of 2T regardless of the input signals 11, 12, . . . 1M, and therefore, delay in turn-on would be decreased.

In addition, in the case where a display panel is driven after it has been left unfired for a long period of time, also since all the matrix cross-points are brought into selected states at a predetermined interval, the ionization probability of the gas interposed between the row and column electrodes can be enhanced, and so, the display panel can be easily fired within a short period.

It is to be noted that even if the NOR gates 21, 22, . . . 2M in the data control section 20 were replaced by OR gates and the OR gates 141, 142, . . . 14N in the scanning control section 140 were replaced by NOR gates, similar combined signals would be obtained.

The above-described discharge at every matrix cross-point occurs only once in a period of 2T, whereas the discharge caused by the row and column driving signals corresponding to the normal input signals containing m toggle pulses occurs m times in a period of T (in the illustrated embodiment, m=3 is chosen for simplicity), and therefore, the contrast ratio in the brightness between the respective discharges is equal to 1:2m. Normally, m is larger than 20, and so, the contrast ratio is lower than 1:40 which gives a practically satisfactory display. Contrast ratio is favorably selected between 1/30 and 1/100. Particular examples are as follows:

Toggle pulse frequency=320 kHz; clock pulse frequency=9 kHz; frame pulse frequency=70 Hz; and operating voltage=130 V.

The panel may be designed for 21 row electrodes and 128 column electrodes utilized for alpha numeric characters using the 7×9 or 5×7 dot-pattern.

In the case where m is small, the delay in the turn-on characteristics can be improved without degrading the quality of display by correspondingly increasing the above-described period 2T of discharges at all the matrix cross-points.

The above-described first preferred embodiment of the present invention employs the system in which all the matrix cross-points in a plasma panel are brought into selected states once in every other period or in every periods with respect to the period in which the column electrodes or row electrodes are scanned out irrespective of the input signals to momentarily fire all these matrix cross-points, and thereby the turn-on time of the display panel is shortened. However, this system has a disadvantage in that in the case of simultaneously firing all the matrix cross-points, the capacity of the driver must be made large because the load becomes extremely large, and accordingly the cost is raised.

Therefore, in order to improve these problems, modification can be made in such manner that the matrix cross-points are divided into a plurality of unit blocks, and all the matrix cross-points in the respective unit blocks are fired successively on a block-by-block basis, and thereby the increase of the load for the driver can be mitigated and the turn-on time can be shortened. For instance, the modifications can be made in such manner that the control pulses 111 in the above-described embodiment which occur at a period of 2T which is twice as large as the period T of the reset pulses 82 in FIG. 2A, may occur at a rate of a plurality of pulses (for example, equal in number to the number of the display figures) per unit period Tu, and upon occurance of the respective pulses the matrix cross-points in the respective figure display regions are successively fired on a region-by-region basis rather than all the matrix cross-points in the display panel are simultaneously fired.

Figures 3A, 3B, 3C, 3D, 3E, 3F, 3G, 3H, 3I, 3J, 3K, 3L, 3M:
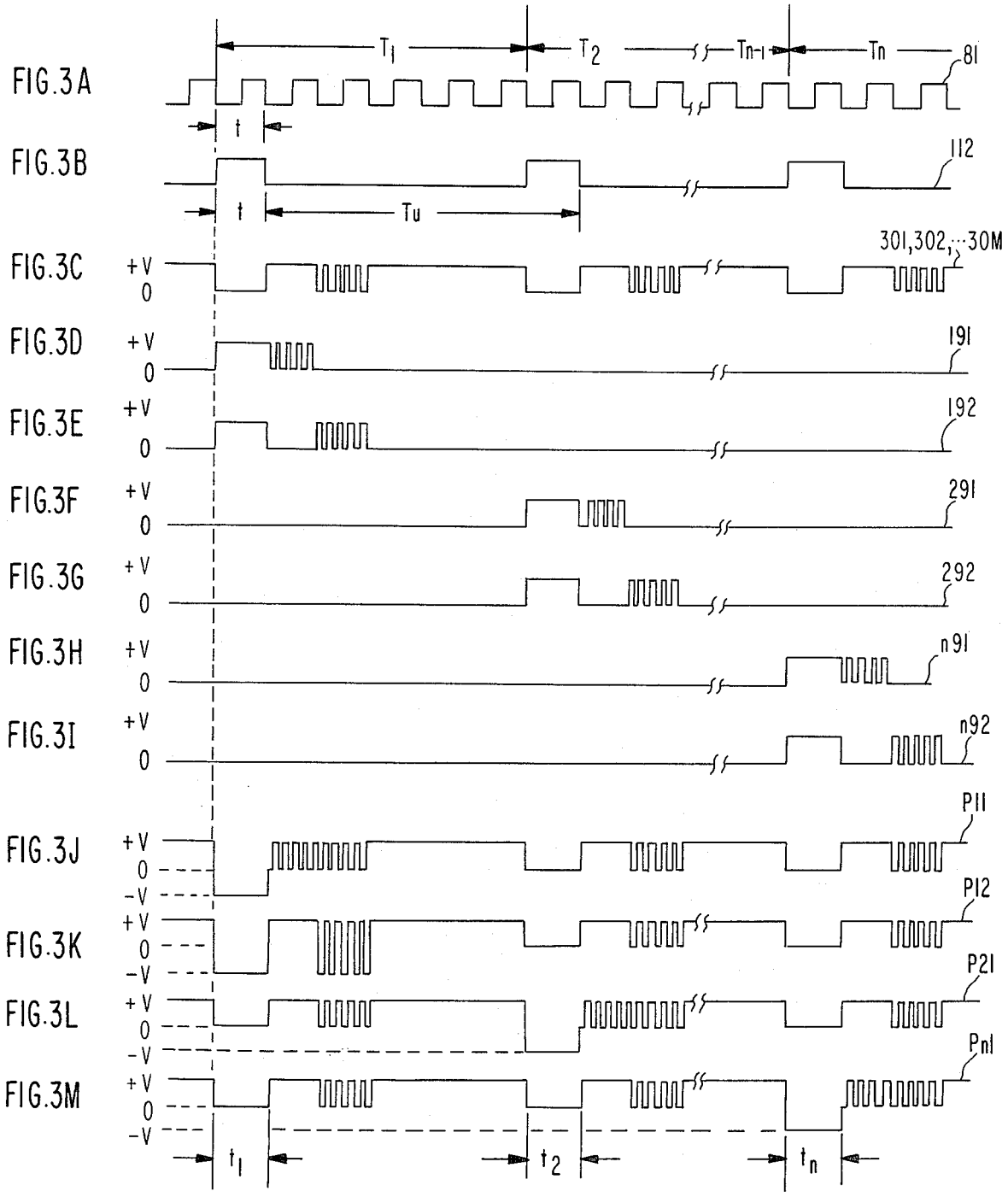
FIGS. 3A to 3M are waveform diagrams showing waveforms at various points in FIG. 1, according to a second preferred embodiment of the present invention.

Explaining in more detail with reference to FIGS. 3A to 3M, control pulses 112 have a pulse width t and the unit period Tu (=6t) as shown in FIG. 3B and they are obtained by frequency-dividing clock pulses 81 (FIG.3A) having a period t by a factor of, for example, six. In more particular in the illustrated embodiment, the column electrodes are divided into n column electrode groups, that is, n unit blocks each consisting of five column electrodes. In the first period $T_1$, the first column electrode group consisting of five column electrodes and all the row electrodes are brought into selected states to fire all the matrix cross-points in the corresponding unit block, and thereafter the five column electrodes in the same unit block are scanned in a normal manner during the remaining five clock periods in the same period $T_1$. In the next period $T_2$, the second column electrode group consisting of five column electrodes and all the row electrodes are brought into selected states to fire all the matrix cross-points in the corresponding second unit block, and thereafter the five column electrodes in the same unit block are scanned in a normal manner during the remaining five clock periods in the same period $T_2$. In the subsequent periods $T_3$, . . . Tn the same operations are repeated until the five column electrodes in the n-th column electrode group or in the n-th unit block have been scanned out at the end of the period Tn. In other words, all the matrix cross-points in each unit block are fired at an interval of nTu ($Tu=T_1=T_2= \ldots =Tn$).

Now description will be made on the successive steps of operation with reference to FIGS. 1 and 3. The control pulses 112 and the input signals are passed through the data control section 20 and inputted to the row driver 30 jointly with the toggle pulses 71 similarly to the above-described first preferred embodiment, and at the output of the row driver 30 are obtained row driving signals 301, 302, . . . 30M as shown in FIG. 3C. For simplicity of explanation, it is again assumed that all the row driving signals 301, 302, . . . 30M are identical. It is to be noted that in the second preferred embodiment, the scanning control section 140 in FIG. 1 is replaced by the modified scanning control section 1400 illustrated in FIG. 4. The output pulses from the decoder 100 are passed through OR gates 1401, 1402, . . . 140N, the other inputs of which are connected to outputs of a second decoder 14. The second decoder 14 successively generates pulses equal in number to the number of the unit blocks, combined with clock pulse counting means (not shown). The control pulses 112 are inputted in the scanning control section 1400 and gated by the outputs of the second decoder 14, then the output pulses from the OR gates 1401, 1402, . . . 140N are inputted to the column driver 90 jointly with the toggle pulses similarly to the first preferred embodiment, and at the output of the column driver 90 are obtained column driving signals 191, 192, 291, 292, n91, n92, etc. as shown in FIGS. 3D to 3I.

More particularly, to the first and second column electrodes 61 and 62 in the first column electrode group are applied pulse waveforms 191 and 192, respectively, illustrated in FIGS. 3D and 3E. Likewise, to the first and second column electrodes in the second column electrode group are applied pulse waveforms 291 and 292, respectively, illustrated in FIGS. 3F and 3G, and to the first and second column electrodes in the last, i.e., n-th column electrode group are applied pulse waveforms n91 and 92, respectively, illustrated in FIGS. 3H to 3I.

A combined signal P11 obtained by combining the row driving signal 301, 302, . . . 30M in FIG. 3C with the column driving signal 191 in FIG. 3D has the waveform illustrated in FIG. 3J, and likewise, combined signals P12, P21 and Pn1 obtained by combining the row driving signal 301, 302, . . . 30M in FIG. 3C with the column driving signals 192, 291 and n91 in FIGS. 3E, 3F and 3H, respectively, have the waveforms illustrated in FIGS. 3K, 3L and 3M, respectively. After all, these combined signals P11, P12, P21, Pn1 are applied between the row electrodes 51, 52, . . . 5M and the column electrodes 61, 62, . . . 6N in the display panel 40. From these combined signal waveforms, it can be seen that all the matrix cross-points in the first unit block are applied with a voltage higher than the firing voltage of the display panel during the time period $t_1$, in the beginning of the first period $T_1$ regardless of the input signals, all the matrix cross-points in the second unit block are applied with the same voltage during the time period $t_2$ in the beginning of the second period $T_2$, and so on. Finally all the matrix cross-points in the n-th unit block are applied with the same voltage during the time period tn in the beginning of the n-th period Tn. Thereby, all the matrix cross-points in the respective unit blocks are successively fired to emit light during the time periods $t_1, t_2 \ldots$ tn, respectively. As described above, owing to the fact that the display panel is divided into a plurality of unit blocks each comprising five column electrodes and all the matrix cross-points in the respective unit blocks are brought into selected states and emit light regardless of the input signals successively during the time periods $t_1, t_2, \ldots$ tn, respectively, the delay in the turn-on characteristics of the display panel can be improved without overloading the row and column drivers. While the above explanation was made taking the group of matrix cross-points formed by five column electrodes and all the row electrodes as one unit block, it is a matter of course that the same effects and advantages can be obtained even if the matrix cross-points within one unit block are either increased or decreased depending upon the loading on the display panel and the loading capacities of the row and column drivers. In view of the ease of control, it is desirable to divide the display panel into figure groups.

In connection to the above-described two preferred embodiments, description was made on a time-division driving system for a matrix type display form. However, it is a matter of course that the present invention is equally applicable to a plasma display panel in a segment type display system.

Now a third preferred embodiment of the present invention as applied to a plasma display panel in a segment type display system will be described with reference to FIGS. 5 and 6. In FIG. 5, after input data 1S have been controlled in a data control section 2S by means of control pulses 111S obtained from a pulse control section 11S, the controlled input data are inputted to a segment driver 3S, where they are mixed with toggle pulses 71S fed from a toggle pulse generator 7S, thereafter the mixed waveforms are stepped up to a driving voltage for a display panel 4S and applied to the corresponding ones of the segment electrodes 5S.

The display panel 4S has such structure that a plurality of segment electrodes 5S1, 5S2, . . . 5Sn are independently arrayed as opposed to the corresponding digit electrodes 6S1, 6S2, . . . 6Sn, respectively, among the digit electrodes 6S so that the so-called static drive can be effected. Accordingly, the segment driving signals applied to the respective segment electrodes 5S1, 5S2, . . . , 5Sn are independently controlled by the respective data corresponding to the respective digits.

On the other hand, in a digit driver 9S, the toggle pulses fed from the toggle pulse generator 7S are steped up to a driving voltage for the display panel to be converted into a digit driving signal which is applied to the digit electrodes 6S. In other words, since the digit electrodes 6S are normally in a selected state, and since the selection of the segment electrodes 5S corresponds to the input data 1S as described above, an optical image corresponding to the input data 1S can be displayed on the display panel 4S.

In the illustrated embodiment, all the segment electrodes 5S are periodically and momentarily brought into selected states regardless of the input data under the control of the control pulses 111S fed from the pulse control section 11S to fire all the cross-regions between the segment electrodes 5S and the digit electrodes 6S, and thereby ionization of the gas interposed between the respective electrodes is assured, resulting in a reduction of the turn-on time.

With reference to FIGS. 6A to 6D, from the pulse control section 11S are obtained control pulses 111S having a pulse width ts and a period Ts as shown in FIG. 6A. The input data 1S are passed through OR gates, the other inputs of which are applied with the control pulses 111S, in the data control section 2S, and inputted to the segment driver 3S jointly with the toggle pulses. At the output of segment driver 3S, a segment driving signal 5S1, 5S2, . . . 5Sn as shown in FIG. 6B. is obtained. If the input data 1S are data for instructing firing, then the segment driving signals 5S1, 5S2, . . . 5Sn take the waveform shown at the time period $T_{S1}$ in FIG. 6B, whereas if the input data are data for instructing unfiring, then the segment driving signals 5S1, 5S2, . . . 5Sn take the waveform shown at the time period $T_{S2}$ in FIG. 6B.

On the other hand, the digit driving signal 6S1, 6S2, . . . 6Sn is a driving signal always containing toggle pulses as shown in FIG. 6C. A combined signal PS obtained by combining the segment driving signal 5S1, 5S2, . . . 5Sn with the digit driving signals 6S1, 6S2, . . . 6Sn takes the waveform shown in FIG. 6D, and this combined signal PS would be applied between the segment and digit electrodes 5S and 6S.

At the time points $\tau_1$ and $\tau_2$, the combined signal PS takes a higher voltage than the firing voltage of the display panel 4S regardless of the input data 1S, so that at all the cross-points between the segment and digit electrodes 5S and 6S discharge occurs and light is emitted.

It is to be noted that while description has been made on the static driving system in connection to the above-described embodiment, as a matter of course, the same effects and advantages can be obtained in the case of the dynamic driving system in which the respective segment electrodes are connected in common, by forcibly firing all the segments at a predetermined period regardless of the display signal.

What is claimed is:

1. An external electrode type plasma display apparatus comprising a group of first electrodes and a group of second electrodes disposed in an opposed relation to each other by the intermediary of a discharging gas to form cells therebetween, a dielectric coating covering the surface of the electrodes of at least one group exposed to said gas, a first driver circuit applied to said first electrodes and having a plurality of input terminals, a second driver circuit coupled to said second electrodes and having a plurality of input terminals, a scanning control means for applying a first signal successively to said input terminals of said first driver circuit for a predetermined period at a predetermined interval, said first driver circuit including means for producing a group of first voltage pulses in response to said first signal and means for applying said first voltage pulses successively to said first electrodes, said first voltage pulses having a predetermined first amplitude with a predetermined polarity, said first amplitude being smaller than a firing voltage of the cells, a signal means for selectively applying a second signal to at least one of said input terminals of said second driver circuit for said predetermined period in synchronism with said first signal, said second driver circuit including means for producing at least one second voltage pulse of an amplitude smaller than said firing voltage in response to said second signal and means for applying said second voltage pulse to said second electrode group so as to produce a first alternating voltage between the electrodes associated with a selected cell in combination with said first voltage pulses, said first alternating voltage having a second amplitude with one and opposite polarities, said second amplitude being larger than said firing voltage, means for applying a third signal simultaneously to all of said input terminals of said first driver circuit, said first driver circuit further including means for producing a third voltage pulse and means for applying said third voltage pulse to a plurality of said first electrodes, and means for applying a fourth signal to all of said input terminals of said second driver circuit in synchronism with said third signal, said second driver circuit further including means for producing a fourth voltage pulse and means for applying said fourth voltage pulse to a plurality of said second electrodes so as to produce a second alternating voltage between said plurality of first electrodes and said plurality of second electrodes, said second alternating voltage having an amplitude larger than said firing voltage and a frequency lower than that of said first alternating voltage so that the number of discharging times due to said second alternating voltage is smaller than that due to said first alternating voltage.

2. The apparatus of claim 1, wherein said second, third and fourth voltage pulses have substantially the same amplitude as said first amplitude of said first voltage pulses, respectively.

3. The apparatus of claim 1, wherein said second, third and fourth pulses have said predetermined polarity.

4. The apparatus of claim 1, wherein said third voltage pulse is applied to all of said first electrodes at the same time while said fourth voltage pulse is applied to all of said second electrodes in synchronism with said third voltage pulse.

5. The apparatus of claim 1, wherein said third voltage pulse is successively applied to a group of a plurality of said first electrodes associated with a respective figure group while said fourth voltage pulse is applied to all of said second electrodes in synchronism with said third voltage pulse .

6. An external electrode type plasma display apparatus comprising a first electrode group and a second electrode group disposed in an opposed relation to each other by the intermediary of a discharging gas to form cells therebetween, a dielectric coating covering surface of the electrodes of at least one group exposed to said gas, a first means for applying a group of first voltage pulses to said first electrode group for a predetermined period in a time-division mode at a predetermined interval, second means for applying a group of second voltage pulses to selected electrodes in said second electrode group for a time of said period in synchronism with said first voltage pulses so as to produce a first alternating voltage between the electrodes associated with a selected cell in combination with said first voltage pulses, the amplitude of said first alternating voltage being larger than the firing voltage of said cell, third means for periodically applying a third voltage pulse simultaneously to a plurality of electrodes in said first electrode group, and fourth means for applying a fourth voltage pulse to said second electrode group in synchronism with said third voltage pulse so as to produce a second alternating voltage between said second electrode group and said plurality of electrodes in said first electrode group, the amplitude of said second alternating voltage being large enough to discharge said cells regardless of said first alternating voltage, the number of discharging times due to said second alternating voltage being smaller than that due to said first alternating voltage so that the contrast of brightness between said selected cells discharged due to said first alternating voltage and the cells discharged due to said second alternating voltage be high, whereby delay in initial discharge is reduced.

7. The apparatus of claim 6, wherein said second, third and fourth voltage pulses have substantially the same amplitude as said first amplitude of said first voltage pulses, respectively.

8. The apparatus of claim 6, wherein said second, third and fourth pulses have said predetermined polarity.

9. The apparatus of claim 6, wherein said third voltage pulse is applied to all of said electrodes at the same time whiel said fourth voltage pulse is applied to all of said second electrodes in synchronism with said third voltage pulse.

10. The apparatus of claim 6, wherein said third voltage pulse is successively applied to a group of a plurality of said first electrodes associated with a respective figure group while said fourth voltage pulse is applied to all of said second electrodes in synchronism with said third voltage pulse.

11. An external electrode type plasma display apparatus comprising a group of first electrodes and a group of second electrodes disposed in an opposed relation to each other by the intermediary of a discharging gas to form cells therebetween, a dielectric coating covering the surface of the electrodes of at least one group exposed to said gas, a first driver circuit coupled to said first electrodes and having a plurality of input terminals, a second driver circuit coupled to said second electrodes and having a plurality of input terminals.

a scanning control means for applying a first signal successively to said input terminals of said first driver circuit for a predetermined period at a predetermined interval, said first driver circuit including means for producing a group of first voltage pulses in response to said first signal and means for applying said first voltage pulses successively to said first electrodes, said first voltage pulses having a predetermined first amplitude with a predetermined polarity, said first amplitude being smaller than a firing voltage of the cells, a signal means for selectively applying a second signal to at least one of said input terminals of said second driver circuit for said predetermined period in synchronism with said first signal, said second driver circuit including means for producing at least one second voltage pulse of an amplitude smaller than said firing voltage in response to said second signal and means for applying said second voltage pulse to said second electrode group so as to produce a first alternating voltage between the electrodes associated with a selected cell in combination with said first voltage pulses, said first alternating voltage having a second amplitude with one and opposite polarities, said second amplitude being larger than said firing voltage, means for applying a third signal simultaneously to all of said input terminals of said first driver circuit, said first driver circuit further including means for producing a third voltage pulse and means for applying said third voltage pulse to a plurality of said first electrodes, means for applying a fourth signal to all of said input terminals of said second driver circuit in synchronism with said third signal, said second driver circuit further including means for producing a fourth voltage pulse and means for applying said fourth voltage pulse to a plurality of said second electrodes so as to produce a second alternating voltage between said plurality of first electrodes and said pluralityof second electrodes, said second alternating voltage having an amplitude larger than said firing voltage and a frequency lower than that of said first alternating voltage so that the number of discharging times due to said second alternating voltage is smaller than that due to said first alternating voltage, and wherein said second, third and fourth voltage pulses have substantially the same amplitude as said first amplitude of said first voltage pulses and the same predetermined polarity as said first voltage pulses.

12. An external electrode type plasma display apparatus comprising a first electrode group and a second electrode group disposed in an opposed relation to each other by the intermediary of a discharging gas to form cells therebetween, a dielectric coating covering surface of the electrodes of at least one group exposed to said gas, a first means for applying a group of first voltage pulses to said first electrode group for a predetermined period in a time-division mode at a predetermined interval, second means for applying a group of second voltage pulses to selected electrodes in said second electrode group for a time of said period in synchronism with said first voltage pulses so as to produce a first alternating voltage between the electrodes associated with a selected cell in combination with said first voltage pulses, the amplitude of said first alternating voltage being larger than the firing voltage of said cell, third means for periodically applying a third voltage pulse simultaneously to a plurality of electrodes in said first electrode group, fourth means for applying a fourth voltage pulse to said second electrode group in synchronism with said third voltage pulse so as to produce a second alternating voltage between said second electrode group and said plurality of electrodes in said first electrode group, the amplitude of said second alternating voltage being large enough to discharge said cells regardless of said first alternating voltage, the number of discharging times due to said second alternating voltage being smaller than that due to said first alternating voltage so that the contrast of brightness between said selected cells discharged due to said first alternating voltage and the cells discharged due to to said second alternating voltage be high, whereby delay in initial discharge is reduced, and wherein said second, third and fourth voltage pulses have substantially the same amplitude as said first amplitude of said first voltage pulses and the same predetermined polarity as said first voltage pulses.

* * * * *

UNITED STATES PATENT AND TRADEMARK OFFICE

CERTIFICATE OF CORRECTION

PATENT NO. : 4,296,357

DATED : October 20, 1981

INVENTOR(S) : Tsutomu HIRAYAMA et al.

It is certified that error appears in the above—identified patent and that said Letters Patent is hereby corrected as shown below:

Column 1, line 12, delete "panles" and insert -- panels --

Column 3, line 36, delete "cross-point" and insert -- cross-points --

Column 4, line 7, delete "takes" and insert -- take --

Column 7, line 32, delete "steped" and insert -- stepped --

Column 8, line 28, delete "applied" and insert -- coupled --

Column 10, line 10, delete "whiel" and insert -- while -- line 29, delete "." and insert -- , --

Column 12, line 21, delete "to", second occurrence.

Signed and Sealed this

*Nineteenth* Day of *January 1982*

[SEAL]

*Attest:*

GERALD J. MOSSINGHOFF

*Attesting Officer*

*Commissioner of Patents and Trademarks*